United States Patent [19]

Stahlecker

[11] Patent Number: 4,537,022

[45] Date of Patent: Aug. 27, 1985

[54] ADJUSTABLE BEARING SUPPORT FOR OPEN-END FRICTION SPINNING ROLLERS

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 634,131

[22] Filed: Jul. 25, 1984

[30] Foreign Application Priority Data

Aug. 30, 1983 [DE] Fed. Rep. of Germany ..... 3331195

[51] Int. Cl.[3] ..... D01H 7/882

[52] U.S. Cl. ..... 57/401; 57/406

[58] Field of Search ..... 57/400, 401, 404, 406, 57/407, 408, 409, 411

[56] References Cited

U.S. PATENT DOCUMENTS 4,222,222 9/1980 Didek et al. ..... 57/401

4,241,571 12/1980 Turk et al. ..... 57/411 X 4,380,892 4/1983 Parker et al. ..... 57/401

*Primary Examiner*—Donald Watkins

*Attorney, Agent, or Firm*—Barnes & Thornburg

[57] ABSTRACT

Apparatus is disclosed for adjustably supporting the friction rollers for an open-end friction spinning unit having two friction rollers that are arranged next to one another and form a wedge-shaped yarn forming gap. The rollers are mounted by means of bearings on non-rotating axles. In the area of the end faces of the friction rollers the non-rotating axles are held by means of holding devices, the spacing of which can be adjusted. Four holding devices arranged in pairs are provided for the axles, where at least between the holding devices of one pair, an adjusting screw is mounted extending transversely to the wedge-shaped gap, by means of which the spacing of said holding devices and thus the size of the wedge-shaped gap, can be adjusted.

14 Claims, 6 Drawing Figures

ADJUSTABLE BEARING SUPPORT FOR OPEN-END FRICTION SPINNING ROLLERS

BACKGROUND AND SUMMARY OF THE INVENTION

This invention relates to apparatus for open-end friction spinning of the type having two friction rollers that are arranged adjacent one another and form a wedge-shaped gap. The friction rollers are mounted on non-rotating support axles by means of bearings. The support axles are held by means of holding means in the area of the outer end faces of the rollers, the spacing of which holding means can be adjusted.

In the case of known construction described in German Published Unexamined Patent Application (DE-OS) No. 31 41 733, the holding means that are assigned to an axle are, in each case, disposed on a console. One of the two consoles is fastened at the machine frame in a stationary manner, while the other console is guided so that it can be adjusted transversely to the wedge-shaped gap for adjusting the width of the wedge-shaped gap of the rollers. For this purpose, spreading wedges are arranged in the area of both ends between the consoles, said spreading wedges being slidable in the longitudinal direction of the consoles and thus in the longitudinal direction of the axles by means of adjusting screws. The movable console, by means of spring assemblies, is pressed against the spreading wedges. By means of a construction of this type, it is difficult to achieve a sensitive adjustment of the wedge-shaped gap between the rollers which must take place only in the range of several hundredths of a millimeter. In addition, this construction is quite expensive and not suitable for a series-produced machine where about 200 of such spinning devices are provided.

An object of the invention is to develop a device of the initially mentioned type in such a way that the spacing of the rollers can be adjusted sensitively by means of the adjustment of the spacing of the holding means of the axles and wherein the construction is very simple permitting use thereof in a series-produced machine.

This object is achieved according to one aspect of the invention by providing four holding means arranged in pairs for the axles, where at least between the holding means of one pair, an adjusting screw is disposed extending transversely to the wedge-shaped gap by means of which the spacing of said holding means can be adjusted.

By using an adjusting screw extending transversely to the wedge-shaped gap, the adjustment is very sensitive since no other working means have to be provided. In this case, it may be sufficient to adjust the wedge-shaped gap only via the pair of holding means in the area of one end face of the rollers, namely in the area where the spun yarn is formed, i.e., where the starting tip of the yarn is located. The wedge-shaped gap should be the narrowest in this area. For this reason, the adjustability of the wedge-shaped gap in this area, i.e., in the area of the roller end faces facing away from the yarn withdrawal direction, has increased significance in regard to the movability and the setting. Only a few additional elements are required to permit the movability.

In practice, it is advantageous for the holding means to be adjustable against a spring force by means of the adjusting screw. In order not to have to provide any additional components in this case, it is provided in a further development of the invention that the holding means are mounted at a support at a distance to the receptacles for the axles and can be elastically deformed by means of the adjusting screw.

In order to permit a reduction and an enlargement of the wedge-shaped gap in the same manner and to rigidly support the holding means in both directions, it is provided in another development of the invention that an adjusting screw is arranged between the holding means of one pair, said adjusting screw reaching into threaded boreholes of the holding means by means of bolts provided with opposing threads. By means of this development, a very sensitive adjustment can be carried out, where it is not absolutely necessary that one or both holding means are flexible in a spring-elastic manner, as long as one of the two holding means is slidably guided in the adjusting direction.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
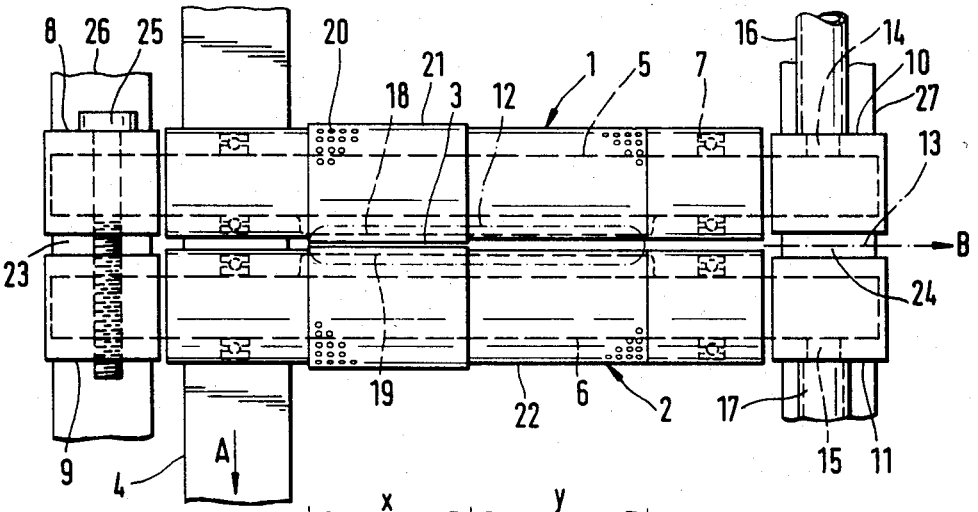
FIG. 1 is a top view of the friction rollers and bearing means of an open-end friction spinning unit constructed in accordance with a preferred embodiment of the present invention.

In order not to obscure the invention in the drawings and the following description, only those portions of an open-end friction spinning machine are shown and described as are deemed necessary for one skilled in this art to make and use the same.

The open-end friction spinning unit shown only partially in FIG. 1 is part of a machine which is provided with a large number of open-end friction units of that type that are arranged next to one another, preferably in one row each on both sides of the machine. The spinning has two rollers 1 and 2 which together form a wedge-shaped yarn forming gap 3. The two rollers 1 and 2 are driven in the same rotational direction by an tangential belt 4 extending in the direction of the Arrow A in longitudinal direction of the machine and in the process driving the rollers of all open-end friction spinning devices of at least one side of the machine. The tangential belt 4 runs directly against the outside shells of the rollers 1 and 2. The outside shells of the rollers 1 and 2 are mounted on non-rotating axles 5 and 6 in the areas adjacent their end faces by means of roller bearings 7. The tangential belt 4 runs against the outside shells of the rollers 1 and 2 in an area under which the roller bearings 7 are located. The axle 5 and 6 project from the end faces of the rollers 1 and 2 and are held by the holding means 8, 9, 10, and 11.

A fiber feeding channel leads into the area of the wedge-shaped gap 3, only the mouth 12 of said channel being schematically shown in FIG. 1 by means of a dash-dotted line and extending in the direction of the wedge-shaped gap 3. Individual fibers are fed via said fiber feeding channel, said individual fibers being taken from a sliver by means of a feeding and opening device that is not shown in detail. The fibers fed into the wedge-shaped gap 3 are there twisted into a yarn 13 which is withdrawn in the direction of the Arrow B in the longitudinal direction of the wedge-shaped gap 3 by a withdrawal device that is not shown and is subsequently wound onto a spool that is also not shown.

The axles 5 and 6 are formed as hollow axles and are made from pipe sections which are closed at their end faces. Each of the axles 5 and 6 are connected to respective vacuum pipes 16 and 17 via cross holes 14 and 15 in their respective bearing holders 10 and 11. In the area of the mouth 12 of the fiber feeding channel, the pipe sections have slot opening 18 and 19, the edges of which are guided to be close to the inside surface of the outside shells of the rollers 1 and 2 and which are aimed at the area of the wedge-shaped gap 3. The outside shells of the rollers 1 and 2 are provided with perforations 20 in the area of the mouth 12 of the fiber feeding channel so that the vacuum applied via the slot openings 18 and 19 becomes effective in the area of the wedge-shaped gap 3. Thus the fed fibers and also the forming yarn 13 are held in the area of the wedge-shaped gap 3.

Figure 2:
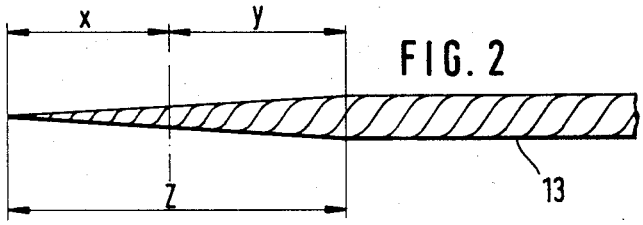
FIG. 2 is an enlarged view of the yarn spun in a friction spinning device during its formation.

The mouth 12 of the fiber feeding channel forms a so-called fiber scatter or distribution zone, the individual fibers being fed distributed over its length. The forming yarn 13 which in FIG. 2 is shown significantly enlarged, thus extends opposite the yarn withdrawal direction B with a tip having a length Z corresponding to the length of mouth 12 of the fiber feeding channel. Approximately in the center of this area Z, after a length x, about half of the fibers are bound into the forming yarn while the other half will not be fed before the second section y. Area x is especially critical for the yarn formation, especially in regard to the wedge-shaped gap 3, i.e., in regard to the spacing between the outside shells of the rollers 1 and 2. In order to have a wedge-shaped gap that is as narrow as possible in this area x, the rollers 1 and 2 there have a slightly enlarged diameter area 21 which, in area y, is followed by a reduced diameter area 22.

In order to adjust the wedge-shaped gap 3, especially in area x, the holding means 8 and 9 at the end facing away from the yarn withdrawal direction B are developed and connected with one another in such a way that their spacing and thus also the spacing of the rollers 1 and 2 can be adjusted. It is also contemplated by the invention to develop the opposite pair of holding means 10 and 11 or all holding means to be adjustable with respect to one another.

Figure 3:
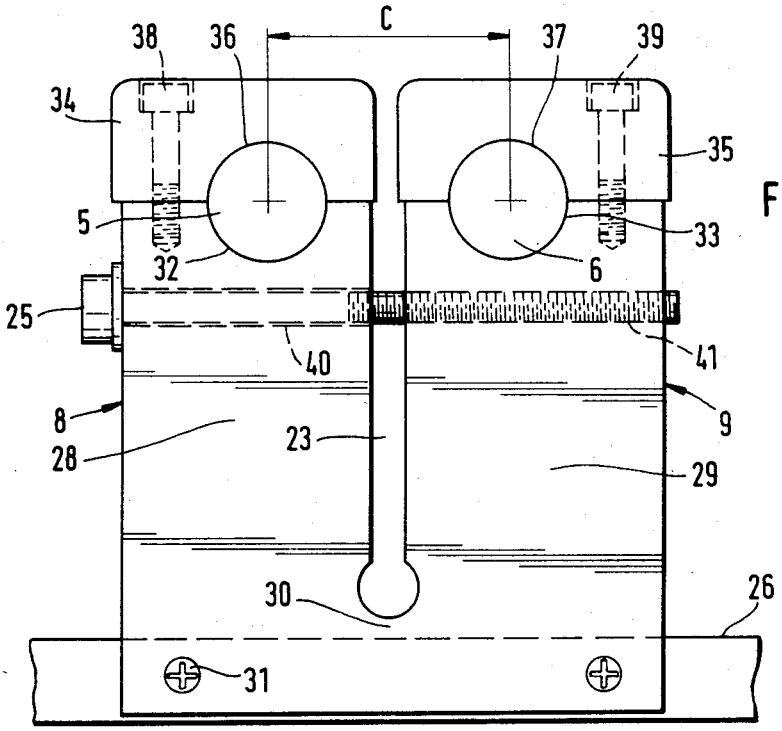
FIG. 3 is an enlarged front view of the device according to FIG. 1 having a pair of holding means developed as a one-piece component.

In the case of the embodiment according to FIG. 3, the pair of holding means 8 and 9 are formed as a one-piece component. This component—looking into the direction of the axles 5 and 6—has the shape of a U, where the holding means 8 and 9 each form a respective leg 28 and 29 and are connected with one another by a cross bar section 30. Between the two legs 28 and 29, the component is divided by a slot 23. The component forming the holding means 28 and 29 is mounted at a support 26 by means of screws 31, one screw each being located in the area of the respective legs 28 and 29.

The ends of the holding means 8 and 9 facing away from the cross bar 30 have semicylindrical recesses 32 and 33 into which the axles 5 and 6 are placed and are clamped in by means of counterparts 34 and 35 having recesses 36 and 37, said counterparts 34 and 35 being screwed to the holding means 8 and 9 by means of screws 38 and 39.

At a distance to the fastening at the support 26 and in the proximity of the recesses 32 and 33, the holding means 8 and 9 are connected with one another by means of an adjusting screw 25 extending transversely to the axles 5 and 6 and thus also to the wedge-shaped gap. The adjusting screw 25 has a head and penetrates a borehole 40 of the holding means 8 and is screwed into a threaded borehole 41 of the holding means 9. It is especially advantageous according to the invention to provide a fine-pitch thread with a low slope for the adjusting screw 25 and the thread borehole 41. By turning the adjusting screw 25, the distance C between the axles 5 and 6 and therefore also the width of the wedge-shaped gap 3 can be adjusted. In the process, the holding means 8 and 9 are slightly elastically deformed so that a sensitive adjustment is possible. It is advantageous in this case to select the initial distance C between the axles 5 and 6 in such a way that it corresponds to the maximally desired width of the wedge-shaped gap 3 so that, by turning the adjusting screw 25, the width of the wedge shaped gap 3 can be adjusted from the maximum value to the zero value. During an adjustment, both bearing holders 8 and 9 move at the same time so that the position of the wedge-shaped gap 3 relative to the mouth 12 of the fiber feeding channel (FIG. 1) also does not change by means of an adjustment of the width of the wedge-shaped gap 3.

Figure 4:
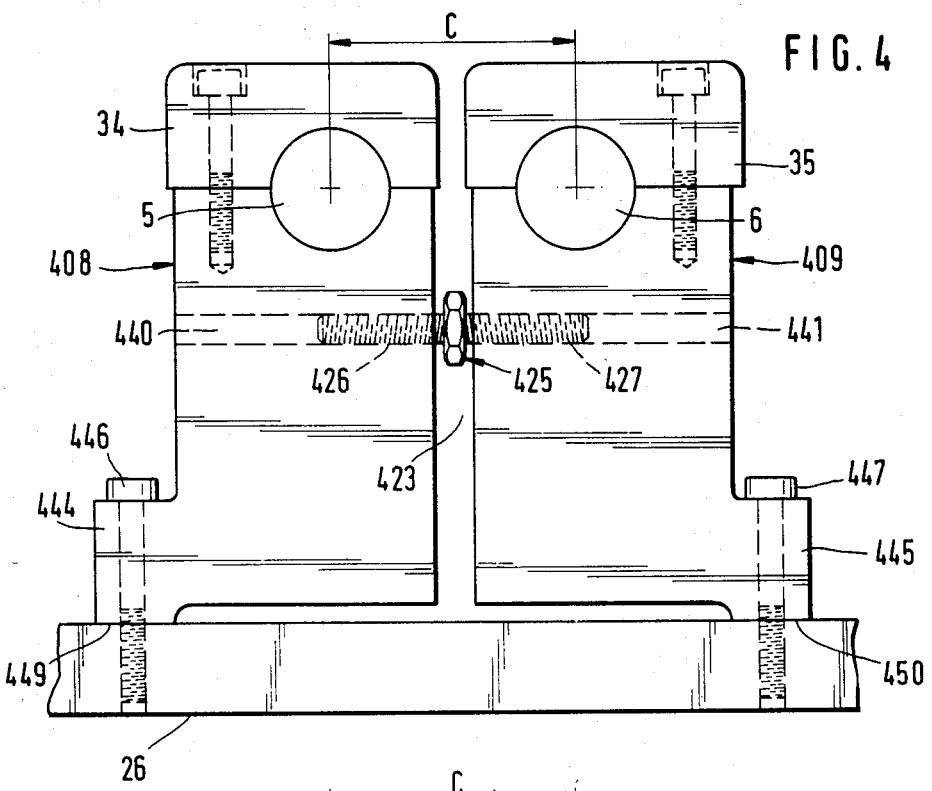
FIG. 4 is a front view similar to FIG. 3 showing a two-piece pair of holding means constructed according to another preferred embodiment of the invention.

In the case of the embodiment according to FIG. 4, two holding means 408 and 409 are provided which are manufactured to be components which are independent from one another and which are mounted at the support 26 by means of screws 446 and 447, via flanges 449 and 450. In this case, the holding means 408 and 409 stand on the support 26 only with the area of the flanges 449 and 450 which, with respect to the other parts of the holding means 408 and 409 form clamping points 444 and 445 that are slightly staggered toward the outside. At the areas facing away from the clamping points 444 and 445, the axles 5 and 6 are clamped by means of the counterparts 34 and 35 into the holding means 408 and 409 in a manner corresponding to the embodiment according to FIG. 3. At a distance to the clamping points 444 and 445 and in proximity of the axles 5 and 6, an adjusting screw 425 is arranged between the holding means 408 and 409, extending transversely to the axles 5 and 6 and therefore also to the wedge shaped gap 3. Said adjusting screw 425 is screwed into corresponding threaded boreholes 440 and 441 of the holding means 408 and 409 by means of two bolts 426 and 427 that are opposite one another and have opposing threads. By turning the adjusting screw 425 which, in the area between the holding means 408 and 409, is provided with a profile that is suitable for the application of a tool, the holding means 408 and 409 can be spread apart or pulled together with a corresponding enlargement or reduction of the wedge-shaped gap 3. Thus an elastic deformation takes place in the area of the clamping points 444 and 445. This embodiment can also do without an elastic deformation by loosening at least one of the screws 446 and 447 for the adjusting of the wedge-shaped gap 3. In order to secure the adjusted position, additional nuts may be screwed onto the bolts 426 and 427 which may then be checked against the opposing surfaces of the holding means 408 and 409.

Figure 5:
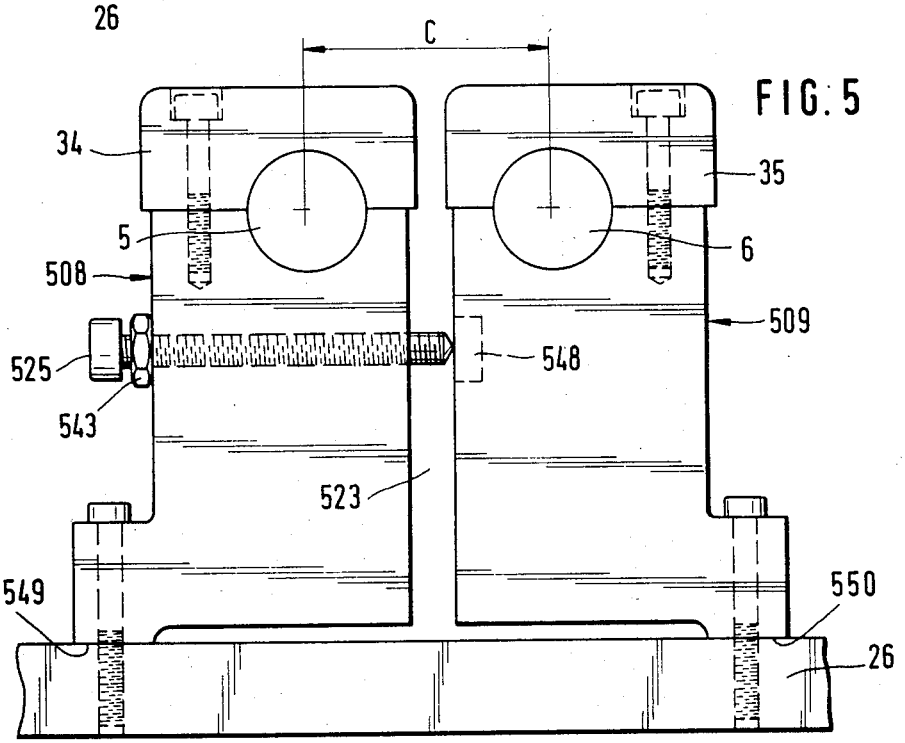
FIG. 5 is a front view similar to FIG. 4 showing another preferred embodiment of the invention.

The holding means 508 and 509 according to FIG. 5 correspond substantially in their construction to the holding means 408 and 409 according to FIG. 4. The holding means 508 and 509 represent individual components and are fastened on a support 26 by means of flanges 549 and 550, leaving a gap 523 between them. The axles 5 and 6, by means of counterparts 34 and 35, are clamped in at the end areas that are opposite the flanges 549 and 550. An adjusting screw 525 is screwed into a threaded borehole in the holding means 508, said adjusting screw supporting itself with a point against a stop 548 of the opposite holding means 509. A counter nut 543 is also screwed onto the adjusting screw 525. In the case of this embodiment, it is advantageous to provide that the holding means 508 and 509 are mounted in such a way that the roller shell surfaces carried by the axles 5 and 6 rest against one another. Subsequently, the desired space between the shell surfaces of the rollers 1 and 2 and thus the width of the wedge-shpaed gap 3 is adjusted by turning the adjusting screw 525, the holding means 508 and 509 slightly and evenly deforming themselves elastically.

Figure 6:
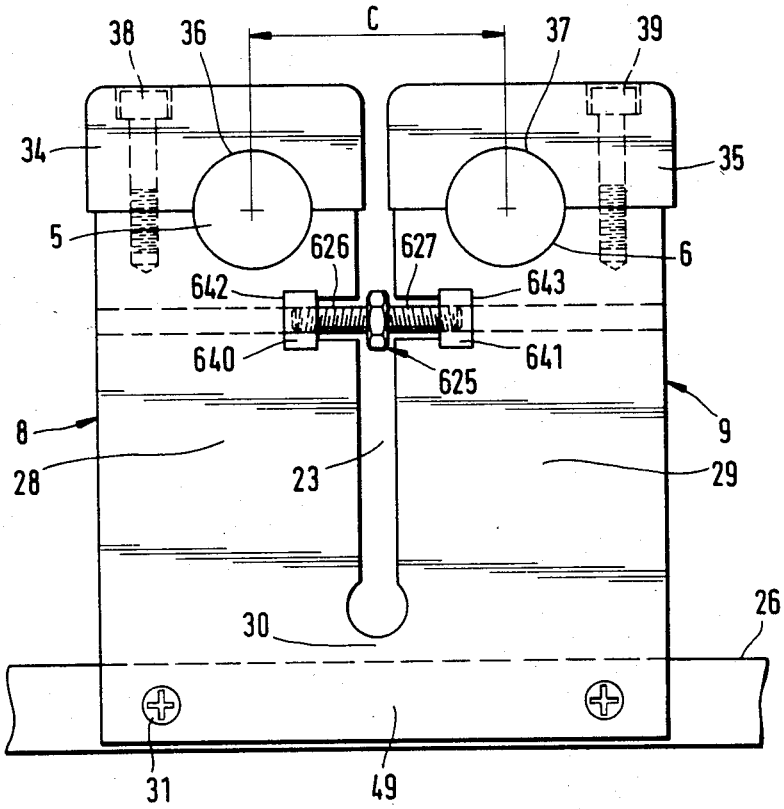
FIG. 6 is a front view of yet another embodiment of the invention.

The holding means of the embodiment according to FIG. 6 corresponds to the holding means of the embodiment according to FIG. 3, i.e., the holding means 8 and 9 form a one-piece component. An adjusting screw 625 is arranged between the two holding means 8 and 9, said adjusting screw having two bolts 626 and 627 provided with two opposing threads and projecting toward different sides. Said bolts 626 and 627 are screwed into threaded inserts 640 and 641 having an undercut slot-shaped opening in the direction of the opposite sides, where the bolts 626 and 627 are located. In addition, the recesses 642 and 643 are open at least toward one side seen in longitudinal direction of the axles 5 and 6 so that the threaded inserts 640 and 641 may be inserted together with the adjusting screw 625.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Friction roller support apparatus for open end friction spinning machines of the type having two friction rollers arranged next to one another forming a wedge shaped yarn forming gap therebetween, said support apparatus comprising:

a pair of non-rotating axle means and bearing means rotatably supporting the respective friction rollers on the axle means, four holding means arranged in pairs and at opposite ends of the friction rollers including receptacle means for receiving the axle means, and adjusting screw means disposed between one pair of holding means, said adjusting screw means extending transverse to the longitudinal extension of the wedge shaped gap and being operable to adjust the spacing of the holding means with respect to one another to thereby adjust the size of the wedge shaped gap.

2. Apparatus according to claim 1, wherein the friction rollers are formed of outside shells which are mounted directly on the non-rotating axle means by means of roller bearings forming the bearing means.

3. Apparatus according to claim 2, wherein the outside shells are perforated and wherein the non-rotating axle means are hollow axles which are connected to a vacuum source and which are provided with suction slots that are open in the direction of the wedge-shaped gap and reach up to the inside surface of the perforated outside shells.

4. Apparatus according to claim 1, wherein the holding means can be adjusted against a spring force by means of the adjusting screw means.

5. Apparatus according to claim 3, wherein the holding means can be adjusted against a spring force by means of the adjusting screw means.

6. Apparatus according to claim 4, wherein the holding means are mounted at a support at a distance to the receptacle means for the non-rotating axle means and are elastically deformable by means of the adjusting screw means.

7. Apparatus according to claim 5, wherein the holding means are mounted at a support at a distance to the receptacle means for the non-rotating axle means and are elastically deformable by means of the adjusting screw means.

8. Apparatus according to claim 1, wherein the holding means which in each case form one pair, are developed as a one-piece part and are connected with one another by a bar section at a distance from the receptacle means for the non-rotating axle means.

9. Apparatus according to claim 4, wherein the holding means which in each case form one pair, are developed as a one-piece part and are connected with one another by a bar section at a distance from the receptacle means for the non-rotating axle means.

10. Apparatus according to claim 7, wherein the holding means which in each case form one pair, are developed as a one-piece part and are connected with one another by a bar section at a distance from the receptacle means for the non-rotating axle means.

11. Apparatus according to claim 1, wherein the adjusting screw means includes an adusting screw arranged between the holding means of one pair, said adjusting screw being provided with opposing threads by means of bolts and engages in threaded boreholes of the holding means.

12. Apparatus according to claim 4, wherein the adjusting screw means includes an adjusting screw arranged between the holding means of one pair, said adjusting screw being provided with opposing threads by means of bolts and engages in threaded boreholes of the holding means.

13. Apparatus according to claim 7, wherein the adjusting screw means includes an adjusting screw arranged between the holding means of one pair, said adjusting screw being provided with opposing threads by means of bolts and engages in threaded boreholes of the holding means.

14. Apparatus according to claim 10, wherein the adjusting screw means includes an adjusting screw arranged between the holding means of one pair, said adjusting screw being provided with opposing threads by means of bolts and engages in threaded boreholes of the holding means.

* * * * *